United States Patent [19]

Carey, Jr. et al.

[11] Patent Number: 4,837,067

[45] Date of Patent: Jun. 6, 1989

[54] NONWOVEN THERMAL INSULATING BATTS

[75] Inventors: Patrick H. Carey, Jr., Bloomington; Joseph P. Kronzer, Roseville, both of Minn.

[73] Assignee: Minnesota Mining and Manufacturing Company, St. Paul, Minn.

[21] Appl. No.: 60,041

[22] Filed: Jun. 8, 1987

[51] Int. Cl.[4] ..... B32B 5/12; D04H 1/00; D04H 1/58

[52] U.S. Cl. ..... 428/108; 428/105; 428/107; 428/112; 428/113; 428/114; 428/119; 428/222; 428/284; 428/286; 428/288; 428/296; 428/299

[58] Field of Search ..... 428/105, 107, 108, 109, 428/110, 111, 112, 113, 114, 119, 284, 286, 296, 288, 198, 280, 282, 222, 299

[56] References Cited

U.S. PATENT DOCUMENTS

| | | | |
|---|---|---|---|
| 3,892,909 | 7/1975 | Miller | 428/371 |
| 3,905,057 | 9/1975 | Willis et al. | 5/337 |
| 4,025,680 | 5/1977 | Botsolas et al. | 428/105 X |
| 4,065,599 | 12/1977 | Nishiumi et al. | 428/402 |
| 4,118,531 | 10/1978 | Hauser | 428/224 |
| 4,128,678 | 12/1978 | Metcalfe et al. | 428/119 |
| 4,144,294 | 3/1979 | Werthaiser et al. | 264/15 |
| 4,238,257 | 12/1980 | Remi et al. | 428/119 X |
| 4,259,400 | 3/1981 | Bolliand | 428/288 |
| 4,392,903 | 7/1983 | Endo et al. | 156/167 |
| 4,418,103 | 11/1983 | Tani et al. | 428/4 |
| 4,433,019 | 2/1984 | Chumbley | 428/110 |
| 4,588,635 | 5/1986 | Donovan | 428/288 |
| 4,618,531 | 10/1986 | Marcus | 428/283 |

FOREIGN PATENT DOCUMENTS

| | | | |
|---|---|---|---|
| 454491 | 2/1949 | Canada | 428/119 |
| 584108 | 4/1976 | Switzerland | 428/105 |

OTHER PUBLICATIONS

Dent, Robin W. et al., Development of Synthetic Down Alternatives, Tech. Report Natick/TR-86/021L-Final Report, Phase 1.

*Primary Examiner*—Lorraine T. Kendell
*Attorney, Agent, or Firm*—D. M. Sell; W. N. Kirn; C. Truesdale

[57] ABSTRACT

A nonwoven thermal insulating batt is provided. The batt comprises structural staple fibers and bonding staple fibers, the fibers being entangled and substantially parallel to the faces of the batt at the face portions and substantially perpendicular to the faces of the batt in the central portion of the batt. The bonding staple fibers are bonded to the structural staple fibers and other bonding staple fibers at points of contact. Also provided is a method of making the nonwoven thermal insulating batt which comprises air-laying a web of structural staple fibers and bonding staple fibers with the fibers being entangled and substantially parallel to the faces of the web at the face portions and in an angled, layered configuration in the central portions of the web. The air-laid web is reconfigured such that the fibers in the central portion of the web are substantially parallel and perpendicular to the faces of the web and the fibers are bonded to stabilize the reconfigured web to form the nonwoven thermal insulating batt.

15 Claims, 2 Drawing Sheets

NONWOVEN THERMAL INSULATING BATTS

FIELD OF THE INVENTION

This invention relates to insulating and cushioning structures made from synthetic fibrous materials and more particularly to thermal insulating materials having insulating performance comparable to down.

BACKGROUND OF THE INVENTION

A wide variety of natural and synthetic filling materials for thermal insulation applications, such as in outerwear, e.g., ski jackets and snowmobile suits, sleeping bags, and bedding, e.g., comforters and bedspreads, are known.

Natural feather down has found wide acceptance for thermal insulation applications, primarily because of its outstanding weight efficiency and resilience. Properly fluffed and contained in an envelope to control migration within a garment, down is generally recognized as the insulation material of choice. However, down compacts and loses its insulating properties when it becomes wet and exhibits a rather unpleasant odor when exposed to moisture. Also a carefully controlled cleaning and drying process is required to restore the fluffiness and resultant thermal insulating properties to a garment in which the down has compacted.

There have been numerous attempts to prepare synthetic fiber-based substitutes for down which would have equivalent thermal insulating performance without the moisture sensitivity of natural down.

U.S. Pat. No. 3,892,909 (Miller) discloses fibrous bodies simulating natural bird down which include larger circular bodies, or figures of revolution, and smaller feather bodies, the feathery bodies tending to fill the voids formed by the larger circular bodies. The fibrous bodies are preferably formed from synthetic fiber tow.

U.S Pat. No. 4,588,635 (Donovan) describes synthetic down thermal insulating materials which are batts of plied card-laps of a blend of 80 to 95 weight percent of spun and drawn, crimped, staple, synthetic polymeric microfibers having a diameter of from 3 to 12 microns and 5 to 20 weight percent of synthetic polymeric staple macrofibers having a diameter of from more than 12, up to 50 microns. Donovan describes this fiber blend as comparing favorably to down or mixtures of down with feathers as an insulator in that it will provide an equally efficient thermal barrier, be of equivalent density, possess similar compression properties, have improved wetting and drying characteristics, and have superior loft retention while wet. These batts are formed by physical entanglement of the fibers achieved during carding. An expanded discussion of these same materials can be found in Dent, Robin W. et al., DEVELOPMENT OF SYNTHETIC DOWN ALTERNATIVES, Technical Report Natick/TR-86/021L—Final Report, Phase 1.

U.S. Pat. No. 4,392,903 (Endo et al.) discloses a thermal insulating bulky product which has a structural make-up of substantially continuous, single fine filaments of from about 0.01 to about 2 deniers which are stabilized in the product by a surface binder. Generally, the binder is a thermoplastic polymer such as polyvinyl alcohol or polyacrylic esters which is deposited on the filaments as a mist of minute particles of emulsion before accumulation of the filaments.

U.S. Pat. No. 4,118,531 (Hauser) discloses a thermal insulating material which is a web of blended microfibers with crimped bulking fibers which are randomly and thoroughly intermixed and intertangled with the microfibers. The crimped bulking fibers are generally introduced into a stream of blown microfibers prior to their collection. This web combines high thermal resistance per unit of thickness and moderate weight.

U.S. Pat. No. 4,418,103 (Tani et al.) discloses the preparation of a synthetic filling material composed of an assembly of crimped monofilament fibers having crimps located in mutually deviated phases, which fibers are bonded together at one end to achieve a high density portion, while the other ends of the fibers stay free. This fill material is described as having superior bulkiness and thermal insulation properties. This filling material is described as being suitable for filling a mattress, bed, pad, cushion pillow, stuffed doll, sofa, or the like, as well as being a down substitute suitable for filling jackets, sleeping bags, ski wear, and night gowns.

U.S. Pat. No. 4,259,400 (Bolliand) discloses a fibrous padding material simulating natural down, the material being in the form of a central filiform core which is relatively dense and rigid and to which are bonded fibers which are oriented substantially transversely relative to this core, the fibers being entangled with one another so as to form a homogeneous thin web and being located on either side of the core, substantially in the same plane.

U.S. Pat. No. 4,433,019 (Chumbley) discloses another approach to thermal insulating fabrics wherein staple fiber is needle-punched through a metallized polymeric film and through a nonwoven polyester sheet and the film and sheet are placed adjacent to each other such that the needle-punched fibers protrude from each face of the fabric to produce a soft, breathable fleece-like material.

U.S. Pat. No. 4,065,599 (Nishiumi et al.) discloses down-like synthetic filler material comprising spherical objects made up of filamentary material with a denser concentration of filaments near the surface of the spherical object than the filament concentration spaced apart from the surface.

U.S. Pat. No. 4,144,294 (Werthaiser et al.) discloses a substitute for natural down comprising sheets of garneted polyester which are separated into a plurality of small pieces, each of which pieces is generally formed into a rounded body. Each of the rounded bodies include a plurality of randomly oriented polyester fibers therein, and each of the rounded bodies provides a substantial resiliency to permanent deformation after the application of force to them.

U.S. Pat. No. 4,618,531 (Marcus) discloses polyester fiberfill having spiral-crimp that is randomly arranged and entangled in the form of fiberballs with a minimum of hairs extending from their surface, and having a refluffable characteristic similar to that of down.

U.S. Pat. No. 3,905,057 (Willis et al.) discloses a fiber-filled pillow wherein the fibrous pillow batt has substantially all its fiber oriented parallel to one another and perpendicular to a plane bisecting a vertical cross-section of the pillow. A pillow casing is used to enclose these batts and to keep them in a useful configuration. These fiber-filled pillows are described as having a high degree of resiliency and fluffability, but are not contemplated as thermal insulation materials.

BRIEF SUMMARY OF THE INVENTION

The present invention provides a nonwoven thermal insulating batt having face portions and a central portion between the face portions comprising structural staple fibers and bonding staple fibers, the fibers being entangled and substantially parallel to the faces of the batt at the face portions of the batt and substantially parallel to each other and substantially perpendicular to the face portions of the batt in the central portion of the batt and the bonding staple fibers being bonded to structural staple fibers and bonding staple fibers at points of contact to enhance structural stability of the batt.

The present invention also provides a method of making a thermal insulating nonwoven batt comprising the steps of (a) air-laying a web of structural staple fibers and bonding staple fibers, the web having face portions and a central portion between the face portions and the fibers being entangled and substantially parallel to the faces of the web at the face portions of the web and in an angled, layered configuration in at least the central portion of the web;

(b) reconfiguring said web such that the fiber structure in the central portion of the web is substantially parallel and substantially perpendicular to the faces of the web; and (c) bonding the fibers of the reconfigured web to stabilize the web to form a nonwoven thermal insulating batt.

The nonwoven thermal insulating batt of this invention has thermal insulating properties, particularly thermal weight efficiencies, about comparable to or exceeding those of down, but without the moisture sensitivity exhibited by down. The reconfiguration of the web increases the thickness and specific volume of the web and, thus, the reconfigured web has improved thermal insulating properties of the same web before reconfiguration.

Mechanical properties of the batt such as its resilience, resistance to compressive forces, and density as well as its thermal insulating properties can be varied over a significant range by changing the fiber denier, bonding conditions, basis weight and type of fiber.

DETAILED DESCRIPTION OF THE INVENTION

Figure 1:
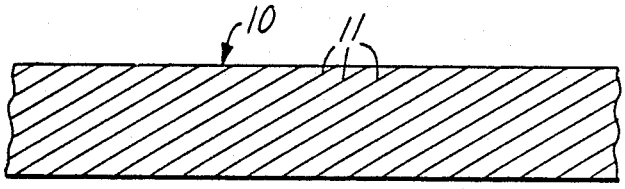
FIG. 1 is a representation of the normal fiber orientation in a web produced in an air laid process on a Rando Webber.

Structural staple fibers, usually single component in nature, which are useful in the present invention include, but are not limited to, polyethylene terephthalate, polyamide, wool, polyvinyl chloride and polyolefin, e.g., polypropylene. Both crimped and uncrimped structural fibers are useful in preparing the batts of the present invention, although crimped fibers, preferably having 1 to 10 crimps/cm, more preferably having 3 to 5 crimps/cm, are preferred.

The length of the structural fibers suitable for use in the batts of the present invention is preferably from about 15 mm to about 75 mm, more preferably from about 25 mm to about 50 mm, although structural fibers as long as 150 mm can be used.

The diameter of the structural fibers may be varied over a broad range. However, such variations alter the physical and thermal properties of the stabilized batt. Generally, finer denier fibers increase the thermal insulating properties and decrease the compressive strength of the batt, while larger denier fibers increase the compressive strength and decrease the thermal insulating properties of the batt. Useful fiber deniers for the structural fibers preferably range from about 0.2 to 15 denier, more preferably from about 0.5 to 5 denier, most preferably 0.5 to 3 denier, with blends or mixtures of fiber deniers often times being employed to obtain desired thermal or mechanical properties for the stabilized batt. Small quantities of microfibers, e.g., less than 20 weight percent, preferably melt blown microfibers in the range of 2–10 microns, may also be incorporated into the batts of the present invention.

A variety of bonding fibers are suitable for use in stabilizing the batts of the present invention, including amorphous, meltable fibers, adhesive coated fibers which may be discontinuously coated, and bicomponent bonding fibers which have an adhesive component and a supporting component arranged in a coextensive side-by-side, concentric sheath-core, or elliptical sheath-core configuration along the length of the fiber with the adhesive component forming at least a portion of the outer surface of the fiber. The adhesive component of the bondable fibers may be bonded, for example, thermally, by solvent bonding, solvent vapor bonding, and salt bonding. The adhesive component of thermally bonding fibers must be thermally activatable (i.e., meltable) at a temperature below the melt temperature of the structural staple fibers of the batt. A range of bonding fiber sizes, e.g. from about 0.5 to 15 denier are useful in the present invention, but optimum thermal insulation properties are realized if the bonding fibers are less than about four denier and preferably less than about two denier in size. As with the structural fibers, smaller denier bonding fibers increase the thermal insulating properties and decrease the compressive strength of the batt, while larger denier bonding fibers increase the compressive strength and decrease the thermal insulating properties of the batt. The length of the bonding fiber is preferably about 15 mm to 75 mm, more preferably about 25 mm to 50 mm, although fibers as long as 150 mm are also useful. Preferably, the bonding fibers are crimped, having 1 to 10 crimps/cm, more preferably having about 3 to 5 crimps/cm. Of course, adhesive powders and sprays can also be used to bond the structural fibers, although difficulties in obtaining even distribution throughout the web reduces their desirability.

One particularly useful bonding fiber for stabilizing the batts of the present invention is a crimped sheath-core bonding fiber having a core of crystalline polyethylene terephthalate surrounded by a sheath of an adhesive polymer formed from isophthalate and terephthalate esters. The sheath is heat softenable at a temperature lower than the core material. Such fibers, available as Melty TM fibers from Unitika Corp. of Osaka, Japan, are particularly useful in preparing the batts of the present invention. Other sheath/core adhesive fibers may be used to improve the properties of the batts of the present invention. Representative examples include fibers having a higher modulus core to improve resilience of the batt or fibers having sheaths with better solvent tolerance to improve dry cleanability of the batts.

The amounts of structural staple fiber and bonding staple fiber in the batts of the present invention can vary over a wide range. Generally, the batts preferably contain from about 20 to 90 weight percent structural fiber and about 10 to 80 weight percent bonding fiber, more preferably from 50 to 70 weight percent structural fiber and about 30 to 50 weight percent bonding fiber.

The nonwoven thermal insulating batts of the invention are capable of providing thermal weight efficiencies of preferably at least about 20 clo/g/m$^2$×1000, more preferably at least about 25 clo/g/m$^2$×1000, most preferably at least about 30 clo/g/m$^2$×1000. The nonwoven batts of the present invention preferably have a bulk density of less than about 0.1 g/cm$^3$, more preferably less than about 0.005 g/cm$^3$, most preferably less than about 0.003 g/cm$^3$. Effective thermal insulating properties are achievable with bulk densities as low as 0.001 g/cm$^3$ or less. To attain these bulk densities, the batts preferably have a thickness in the range of about 0.5 to 15 cm, more preferably 1 to 10 cm, most preferably 2 to 8 cm, and preferably have a basis weight of from 10 to 400 g/m$^2$, more preferably 30 to 250 g/m$^2$, most preferably 50 to 150 g/m$^2$.

The batts of the present invention are formed from air-laid webs of blends of structural staple fibers and bonding staple fibers. These webs, which can be produced on equipment, such as Rando Webber TM air-laying equipment, available from Rando Machine Corp., have a shingled structure which is inherent to the process. FIG. 1 illustrates a typical air-laid web 10 formed on Rando Webber TM air-laying equipment. The fibers are laid down in shingles 11 which normally are inclined at an angle of between about 10° to 40° to the faces of the web. Some of the most important factors influencing the angle of the shingle include the length of the fiber used to form the web, the type of collector used in the machine, and the basis weight of the web.

Generally, longer fibers produce a web having a larger shingle angle than do shorter fibers. A web having a lower basis weight generally has a lower shingle angle than a similar web at a higher basis weight. The collector is generally an inclined wire or a perforated metal cylinder, the cylinder being preferred. Smaller diameter cylinders produce webs having a larger shingle angle than large diameter cylinders produce. The length of the web contact zone on the collector, i.e., the distance in which the web is in contact with the collector cylinder also affects the shingle angle with a longer distance creating a lower shingle angle.

Figure 2:
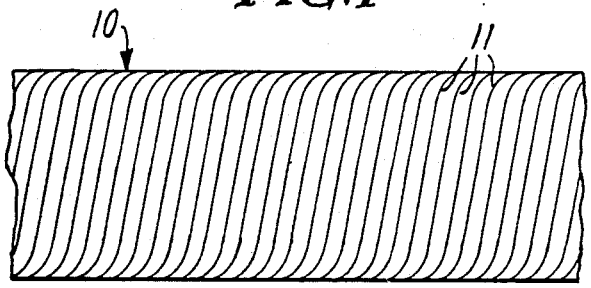
FIG. 2 is a representation of the fiber orientation in a reconfigured batt of the present invention.

The shingled structure of the web can be used to advantage in creating a web structure that has superior thermal weight efficiency to down and that also has the resiliency of down. By reconfiguring the shingle structure from its original shallow angle of 10° to 40°, as shown in FIG. 1, to an angle of at least above 50°, preferably at least about 60°; and most preferably approaching 90°, i.e., 80°–90°, as illustrated in FIG. 2, the web becomes a substantially columnar structure which is capable of enduring compressive challenges and providing lower bulk densities than those associated with the starting web. The reconfigured web structure capitalizes on the natural resilience of the fibers by orienting them substantially lengthwise to the compressive forces exerted on the web.

Several methods are presently available to effect the reconfiguration of the shingled structure in an air laid web, including, but not limited to, running two conveyer belts at differing speeds so as to move one face of the web at a faster down-web speed than the other, a "lift" process, a "sag" process and an optional "combing" or "brushing" step which can be added to either the "lift" or "sag" processes to cause an additional reconfiguring, or repositioning, of the fibers in the web.

Figure 3:
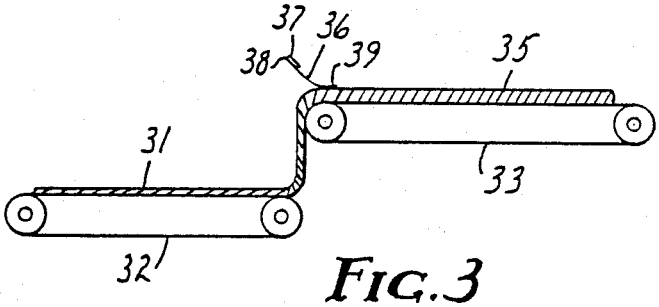
FIG. 3 is a representation of the "lift" process, augmented with a brush, for preparing the batts of the present invention.

In the "lift" process, illustrated in FIG. 3, air-laid web 31, which has the above-described shingle structure, passes from a first transport means 32, such as a conveyer belt, to a second transport means 33, such as a second conveyor belt, which is positioned slightly higher than first transport means 32. By "lifting" the web in this manner, the bottom surface of web 34 is shifted forward relative to the top surface of the web and the shingle structure 35 is concurrently moved toward a more vertical fiber configuration wherein the shingles of the web become more perpendicular to the surface. This process may require several "lifts" to achieve the desired amount of reconfiguration. In FIG. 3, a "brush" 36, which consists of a rectangular piece of 40-pound card stock 37 which is hinged at its top edge 38 so that the bottom edge 39 lightly brushes the top of the web is utilized to introduce further reconfiguration of the shingle structure.

Figure 4:
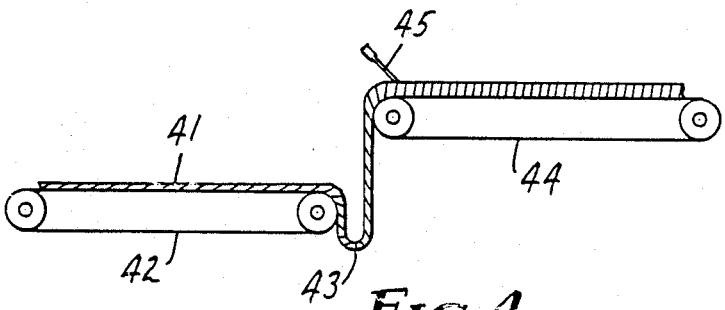
FIG. 4 is a representation of the "sag" process, augmented with a comb, for preparing the batts of the present invention.

In the "sag" process illustrated in FIG. 4, air-laid web 41, which has the above-described shingle structure, is allowed to drop from a first transport means 42, such as a conveyor belt, in an unsupported fashion, and then to develop a "sag" 43 before being picked up by a second transport means 44, such as a second conveyor belt. The "sag" causes the fibrous shingles of the web to move relative to one another and to the faces of the web such that a more vertical fiber structure is produced in the web whereby the shingles become more perpendicular to the surface. The addition of a comb 45, such as a 15 dent comb, which lightly contacts the top surface of the web after the "sag" can be used to introduce further reconfiguration of the fibers, i.e., to cause the fibers to be even more closely vertical to the web face. This "sag" process is generally more efficient than the "lift" process, but may be less controllable, and, therefore, the "lift" process is generally preferred.

While each of these processes results in a reconfiguration of the shingle structure in the central portion of the web, the comparatively non-directional, highly entangled fiber structure on the top and bottom faces of the batt which results from the air laying of the web is not significantly altered.

After the web has been reconfigured, the web is heated sufficiently to effect interfiber bonding by the bonding fibers with other bonding fibers and with structural fibers to stabilize the reconfigured web to form the nonwoven thermal insulating batt of the invention. The temperature of the oven in which the web is heated is preferably about 40° to 70° C. above the temperature at which the adhesive portion of the bondable fiber melts.

The nonwoven thermal insulating batts of the present invention exhibit outstanding thermal insulating properties about comparable to or exceeding those of natural and synthetic down products. While the reasons for this outstanding performance are not fully understood at this time, it is speculated that the columnar structure of the reconfigured web contributes not only to the resilience of the web but also to reducing heat losses from radiation. It is suspected that this possible contribution of the columnar structure to reducing heat loss by radiation may be due to the fact that fibers radiate heat outward from their surface and with perpendicular fibers radiation is predominantly within the plane of the batt rather than outward from the batt.

While the principal application for the batts of the present invention lies in the area of light weight thermal insulation materials, they are also useful for a number of other areas, including acoustical insulation and cushioning applications where the work to compress, resilience, and loft retaining properties of the batts can be advantageously utilized.

The following examples further illustrate this invention, but the particular materials and amounts thereof in these examples, as well as other conditions and details, should not be construed to unduly limit this invention. In the examples, all parts and percentages are by weight unless otherwise specified.

In the examples, thermal resistance of the batts was evaluated with the heat flow upward, according to ASTM-D-1518-64, to determine the combined heat loss due to convection, conduction and radiation mechanisms. Heat losses due to the radiation mechanism were determined using a Rapid-K unit (Dynatech R/D Company of Cambridge, MA) with the heat flow downwards.

EXAMPLES 1–6

Structural fibers (SF) and bonding fibers (BF) were opened and mixed using type B, Rando Webber TM air-laying equipment with the amounts and types of fibers as follows:

Example 1: 60% SF (Fortrel TM Type 510, a polyethylene terephthalate fiber, 1.2 denier, 3.8 cm long, available from Celanese Corp.) and 40% BF (Melty TM Type 4080, a bonding core/sheath fiber, 2 denier, 5.1 cm long, available from Unitika Corp.);

Example 2: 60% SF (Fortrel TM Type 417, a polyethylene terephthalate fiber, 1.5 denier, 3.8 cm long, available from Celanese Corp.) and 40% BF (Melty TM Type 4080, a bonding core/sheath fiber, 4 denier, 5.1 cm long, available from Unitika Corp.);

Example 3: 60% SF (Fortrel TM Type 510) and 40% BF (Melty TM Type 4080, 4 denier, 5.1 cm long);

Example 4: 45% SF (Fortrel TM Type 510), 10% SF (Kodel TM Type 431, a polyethylene terephthalate fiber, 6 denier, 3.8 cm long, available from Eastman Chemical Products, Inc.), and 45% BF (Melty TM Type 4080, 2 denier, 5.1 cm long); and Example 5: 65% SF (Fortrel TM Type 510) and 35% BF (Melty TM Type 4080, 4 denier, 5.1 cm long); and Example 6: 60% SF (Fortrel TM Type 510) and 40% BF (Melty TM Type 4080, 2 denier, 5.1 cm long).

The opened and mixed fiber blends were then air-laid using type B Rando Webber TM air-laying equipment to produce air-laid webs. In Examples 1–4, the web was reconfigured by allowing the web to sag to a depth of about 7 cm in an unsupported manner between a first conveyer, a slot conveyer, and a second conveyer, a galvanized wire screen conveyer, having a 10 cm linear gap between conveyers, the second conveyer being about 30 cm above the first conveyer, and the first conveyer travelling at a rate of 2.4 m/min and the second conveyer traveling at a rate of 2.7 m/min. In Examples 5 and 6, the web was reconfigured by lifting the web from a first conveyer to a second conveyer, the second conveyer being 0 cm linearly distant and 30 cm above the first conveyer, and both conveyers traveling at a rate of 2.7 m/min. In Examples 1, 5, and 6, the web was further reconfigured by brushing the top of the web with a hinged panel of 40-pound/ream stiff card stock paper. In Example 2, the web was further reconfigured by combing the top of the web with a 15-dent textile loom comb. Each reconfigured web was then passed through an air circulating oven at the temperature and dwell time set forth in Table I to achieve a stabilized batt having the basis weight set forth in Table I. The thickness of each batt was determined with a 13.8 Pa force on the face of the batt and the reconfigured shingle angle was measured. The thermal insulating value for each batt was measured and the weight efficiency and thermal insulating value per cm thickness were determined. The results are set forth in Table I.

TABLE I

| Example | 1 | 2 | 3 | 4 | 5 | 6 |
|---|---|---|---|---|---|---|
| Oven temp. (°C.) | 160 | 155 | 155 | 155 | 160 | 160 |
| Dwell time (sec) | 120 | 120 | 150 | 120 | 135 | 120 |
| Basis wt. ($g/m^2$) | 67 | 70 | 90 | 149 | 142 | 68 |
| Thickness (cm) | 2.5 | 2.0 | 2.6 | 4.5 | 3.8 | 2.8 |
| Bulk density ($g/cm^3$) | 0.0027 | 0.0035 | 0.0035 | 0.0033 | 0.0037 | 0.0024 |
| Reconfigured shingle angle (°) | 60–70 | 60–70 | 60–70 | 80–90 | 70–80 | 60–70 |
| Thermal resistance (clo) | 2.12 | 1.91 | 2.42 | 3.56 | 2.78 | 2.08 |
| Weight efficiency ($clo/g/m^2 \times 1000$) | 31.6 | 27.3 | 26.9 | 23.9 | 19.6 | 30.6 |
| Clo/cm thickness | 0.85 | 0.95 | 0.92 | 0.79 | 0.73 | 0.75 |

As can be seen from the data in Table I, the thermal insulating batts of the invention have excellent thermal resistance. The batts of Examples 1 and 6 possess exceptionally superior thermal weight efficiencies at low bulk densities.

EXAMPLE 7 AND COMPARATIVE EXAMPLES C1–C3

Samples of Quallofil TM, available from DuPont, Inc. (Comparative Example C1), Hollofil TM 808, available from DuPont, Inc. (Comparative Example C2), an unbranded commercially available, resin bonded thermal insulation material, (Example C3), and a sample of batt prepared as in Example 1, except having a basis weight of 75 $g/m^2$, (Example 7) were tested for basis weight, thickness, clo value, and weight efficiency. Then a sample of each batt, 28 cm × 56 cm was placed between two sheets of woven nylon fabric, 28 cm × 56 cm, and the perimeter edges were sewn together to form a panel to simulate garment construction. Each panel was used as a seat cushion, being subjected to repeated compressions, twisting, and sideways forces, for eight days. Each panel was then fluffed for 45 minutes in a clothes dryer on air fluff cycle, the batt measured for thickness, clo value, and weight efficiency, then laundered in a Maytag TM home washer using 41 minutes continuous agitation with warm water, and a gentle cycle followed by normal rinse and spin, and dried in a Whirlpool TM home dryer at medium heat on permanent press cycle after each laundering. The thickness, clo value, and weight efficiency of each batt were again measured. All test results are set forth in Table II.

TABLE II

| Example | 7 | C1 | C2 | C3 |
|---|---|---|---|---|
| Basis weight (g/m$^2$) | 75 | 145 | 116 | 157 |
| Bulk density (g/cm$^3$) | | | | |
| Initial | 0.0024 | 0.0044 | 0.0054 | 0.0052 |
| Fluffed | 0.0051 | 0.0055 | 0.0056 | 0.0067 |
| Laundered | 0.0045 | 0.0055 | 0.0059 | 0.0069 |
| Thickness (cm) | | | | |
| Initial | 3.2 | 3.3 | 2.2 | 3.0 |
| Fluffed | 1.5 | 2.7 | 2.1 | 2.4 |
| Laundered | 1.7 | 2.7 | 2.0 | 2.3 |
| Thermal resistance (clo) | | | | |
| Initial | 2.6 | 3.3 | 2.8 | 2.8 |
| Fluffed | 1.9 | 2.8 | 2.2 | 2.5 |
| Laundered | 2.0 | 2.4 | 1.9 | 2.3 |
| Weight efficiency (clo/g/m$^2$ × 1000) | | | | |
| Initial | 34.9 | 22.4 | 23.7 | 17.5 |
| Fluffed | 25.5 | 19.3 | 19.2 | 15.7 |
| Laundered | 26.4 | 16.7 | 16.2 | 14.3 |

As can be seen from the data in Table II, the batt of Example 7 had greater thermal weight efficiency initially and after compression, fluffing, and laundering than the comparative thermal insulating materials.

EXAMPLE 8 AND COMPARATIVE EXAMPLES 4–9

For Example 8, a batt was prepared as in Example 1, except that the basis weight was 70 g/m$^2$. The thermal conductivity for this batt was determined using a Rapid-K unit with the heat flow downward and series of reduced spacings between the hot and cold plates to increase bulk density. Linear regression analysis of the data using bulk density (kg/m$^3$) and the product of the bulk density and thermal conductivity (W/mK) provided an equation where the radiation parameter is given by the intercept of the equation at zero bulk density. Similar determinations were also determined for two commercially available materials: Quallofil TM, 145 g/m$^2$, available from DuPont, Inc., and a 157 g/m$^2$ commercially available resin bonded thermal insulating material. The results are set forth in Table III together with radiation parameters calculated from published data for the other listed thermal insulating materials.

The radiation parameter is particularly useful in determining the relative thermal emissivity of thermal insulating materials. Radiation heat losses become a more important factor in very low density materials where the fiber mass is small and heat loss due to thermal conductivity is minimized. The lower the radiation parameter, the lower the heat loss due to thermal radiation.

TABLE III

| Example | Thermal insulating material | Radiation parameter |
|---|---|---|
| 8 | Batt of invention | 114 |
| C4 | Quallofil TM | 184 |
| C5 | Unbranded material | 290 |
| C6 | Synthetic down (U.S. Pat. No. 4,588,635) | 137 |
| C7 | Polarguard TM | 233 |
| C8 | Hollofil TM II | 295 |
| C9 | Down | 137 |

As can be seen from the data in Table III, the thermal insulating batt of Example 8 yielded a lower radiation parameter than any of the comparative thermal insulating materials including down.

EXAMPLE 9 AND COMPARATIVE EXAMPLES C10–C11

Thermal insulating weight efficiency determinations were made on a batt prepared as in Example 2 (Example 9), Quallofil TM thermal insulating material having a basis weight of 145 g/m$^2$ and a thickness of 3.3 cm (Comparative Example C10), and unbranded commercially available thermal insulating material having a basis weight of 157 g/m$^2$ and a thickness of 3.1 cm (Comparative Example 11). Samples of each material were subjected to forces of compression and tested for thermal efficiency under compression. The results of these tests are shown in FIG. 5, where the solid line (A) represents the weight efficiency of the batt of Example 9 and the dotted line (B) and broken line (C) represent the weight efficiencies of the thermal insulating materials of Comparative Examples C10 and C11, respectively.

Figure 5:
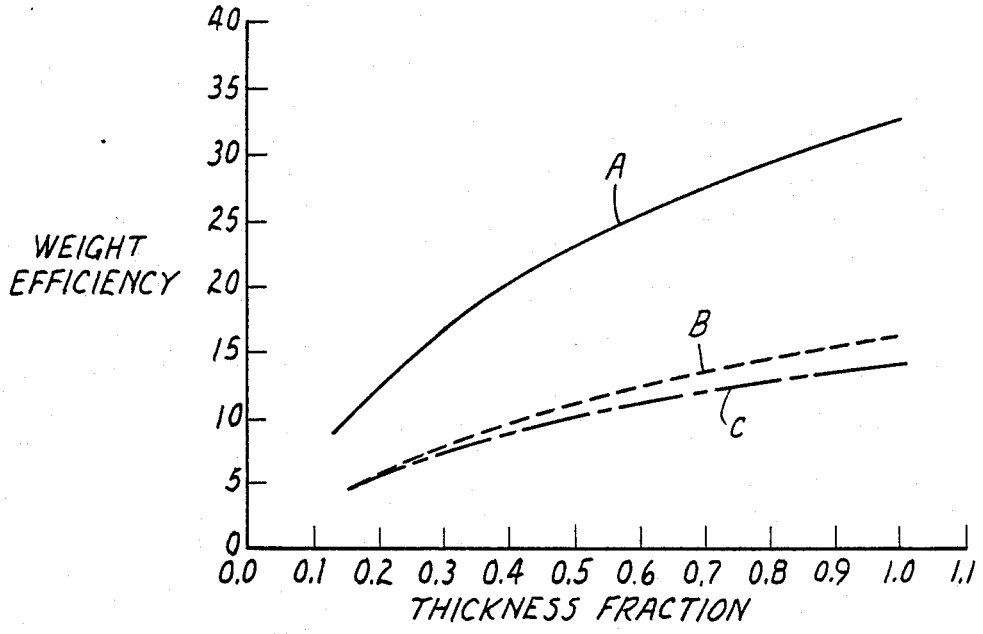
FIG. 5 illustrates the results of the thermal insulating weight efficiency tests of Example 8 and Comparative Examples C10–C11.

As can be seen from FIG. 5, the thermal insulating batt of Example 9 had better thermal weight efficiency at various thickness fractions than either the Quallofil TM or unbranded thermal insulating materials.

What is claimed is:

1. A nonwoven thermal insulating batt having face portions and a central portion between said face portions comprising structural staple fibers and bonding staple fibers, said fibers being entangled and substantially parallel to the faces of the batt in the face portions of said batt and substantially parallel to each other and substantially perpendicular to the faces of said batt in the central portion of said batt and the bonding staple fibers being bonded to structural staple fibers and bonding staple fibers at points of contact to enhance structural stability of the batt.

2. The batt of claim 1 wherein said structural staple fibers are present in an amount of about 20 to 90 weight percent and said bonding staple fibers are present in an amount of 10 to 80 weight percent.

3. The batt of claim 1 wherein said batt has a bulk density of less than about 0.1 g/cm$^3$.

4. The batt of claim 1 wherein said batt has a bulk density of less than about 0.005 g/cm$^3$.

5. The batt of claim 1 wherein said batt is from about 0.5 to 15 cm thick.

6. The batt of claim 1 wherein said batt has a basis weight of from 10 to 400 g/m$^2$.

7. The batt of claim 1 wherein said structural staple fibers have about 1 to 10 crimps/cm.

8. The batt of claim 1 wherein said structural staple fibers are about 15 to 75 mm long.

9. The batt of claim 1 wherein said bonding staple fibers have about 1 to 10 crimps/cm.

10. The batt of claim 1 wherein said bonding staple fibers are about 15 to 75 mm long.

11. The batt of claim 1 wherein said bonding staple fibers are bicomponent fibers having a support component and an adhesive component, the adhesive component forming at least an outer portion of said fibers.

12. The batt of claim 1 wherein said substantially perpendicular fibers are at an angle of about at least 50° to the faces.

13. The batt of claim 1 wherein said substantially perpendicular fibers are at an angle of about at least 60° to the faces.

14. The batt of claim 1 wherein said substantially perpendicular fibers are at an angle of about 80°–90° to the faces.

15. The batt of claim 1 wherein said batt has a thermal weight efficiency of at least about 20 clo/g/m$^2$×1000.

* * * * *